US008741830B2

(12) United States Patent
Orlich et al.

(10) Patent No.: US 8,741,830 B2
(45) Date of Patent: Jun. 3, 2014

(54) METHOD FOR PRODUCING LIQUID PREPARATIONS HAVING A SOLID BODY CONTENT

(75) Inventors: Bernhard Orlich, Dusseldorf (DE); Bernd Richter, Leichlingen (DE); Alexander Lambotte, Dusseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 377 days.

(21) Appl. No.: 11/874,155

(22) Filed: Oct. 17, 2007

(65) Prior Publication Data

US 2008/0262109 A1 Oct. 23, 2008

Related U.S. Application Data

(63) Continuation of application No. PCT/EP2006/002216, filed on Mar. 10, 2006.

(30) Foreign Application Priority Data

Apr. 19, 2005 (DE) ..... 10 2005 018 243

(51) Int. Cl.
*C11D 17/00* (2006.01)
*C11D 3/37* (2006.01)

(52) U.S. Cl.
USPC ..... 510/418; 510/276

(58) Field of Classification Search
CPC ..... C11D 1/72; C11D 3/10
USPC ..... 510/418, 276; 424/468; 514/789; 252/182.11; 426/531; 106/287.35, 316
See application file for complete search history.

(56) References Cited

U.S. PATENT DOCUMENTS

| | | | | | |
|---|---|---|---|---|---|
| 2,166,528 | A | | 7/1939 | Johannes | |
| 2,433,054 | A | | 12/1947 | Lime | |
| 3,234,258 | A | | 2/1966 | Morris et al. | |
| 3,648,741 | A | | 3/1972 | Croasdale et al. | |
| 3,777,477 | A | | 12/1973 | Biondo | |
| 3,904,560 | A | * | 9/1975 | McKenzie | 106/253 |
| 4,159,028 | A | | 6/1979 | Barker et al. | |
| 4,368,089 | A | | 1/1983 | Smith | |
| 4,405,399 | A | | 9/1983 | Gibbons | |
| 4,464,271 | A | | 8/1984 | Munteanu | |
| 4,664,839 | A | | 5/1987 | Rieck et al. | |
| 4,820,439 | A | | 4/1989 | Rieck et al. | |
| 4,891,437 | A | * | 1/1990 | Marquis et al. | 549/529 |
| 4,966,205 | A | | 10/1990 | Tanaka | |
| 5,075,041 | A | | 12/1991 | Lutz et al. | |
| 5,312,595 | A | * | 5/1994 | Moffett et al. | 422/129 |
| 5,356,607 | A | | 10/1994 | Just | |
| 5,780,420 | A | | 7/1998 | Breuer et al. | |
| 5,812,423 | A | * | 9/1998 | Maisotsenko et al. | 703/9 |
| 5,837,272 | A | | 11/1998 | Fierro, Jr. et al. | |
| 2005/0059570 | A1 | | 3/2005 | Hsu | |

FOREIGN PATENT DOCUMENTS

| | | | | | |
|---|---|---|---|---|---|
| DE | 2332877 | | | 1/1974 | |
| DE | 4400024 | | | 7/1995 | |
| DE | 10061418 | A1 | | 8/2002 | |
| EP | 0164514 | | | 12/1985 | |
| EP | 0265128 | A2 | | 4/1988 | |
| EP | 0280537 | A1 | | 8/1988 | |
| EP | 0579467 | A1 | | 1/1994 | |
| EP | 1256621 | A1 | | 11/2002 | |
| EP | 1484389 | A1 | | 12/2004 | |
| EP | 1502944 | A1 | | 2/2005 | |
| FR | 1156513 | | | 5/1958 | |
| GB | 807407 | | | 6/1960 | |
| GB | 873214 | | | 7/1961 | |
| GB | 1303810 | | | 1/1973 | |
| GB | 2 194 793 | A | * | 3/1988 | C11D 3/60 |
| WO | 88/06552 | A1 | | 9/1988 | |
| WO | WO9108171 | | | 6/1991 | |
| WO | WO9507331 | | | 3/1995 | |
| WO | 99/25796 | A2 | | 5/1999 | |
| WO | 00/36060 | A2 | | 6/2000 | |
| WO | 01/91605 | A1 | | 12/2001 | |
| WO | 02/08380 | A1 | | 1/2002 | |
| WO | 02/092439 | A2 | | 11/2002 | |
| WO | 02/100358 | A1 | | 12/2002 | |
| WO | 03/020865 | A2 | | 3/2003 | |
| WO | 2004/012694 | A1 | | 2/2004 | |
| WO | 2004/050055 | A1 | | 6/2004 | |
| WO | 2004/054693 | A1 | | 7/2004 | |
| WO | 2004/081161 | A1 | | 9/2004 | |
| WO | 2004/098559 | A2 | | 11/2004 | |
| WO | 2006/093742 | A1 | | 9/2006 | |

OTHER PUBLICATIONS

Harnby et al., "Mixing in the Process Industries", Butterworth & Co. (Publishers) Ltd., pp. 145-147 & 163-169, 1986.

* cited by examiner

*Primary Examiner* — Aradhana Sasan
(74) *Attorney, Agent, or Firm* — David LeCroy

(57) ABSTRACT

A method for producing a liquid preparation having a solid body content and the resulting liquid preparation. According to the method, the addition of at least a portion of the solid bodies takes place only (a) in the last stage of the method preceding the pouring of the liquid preparation into a packing unit or (b) during the pouring into a packing unit.

9 Claims, No Drawings

METHOD FOR PRODUCING LIQUID PREPARATIONS HAVING A SOLID BODY CONTENT

CROSS-REFERENCE TO RELATED APPLICATIONS

This application is a continuation under 35 U.S.C. §365 (c) and 35 U.S.C. §120 of International Application No. PCT/EP2006/002216 filed Mar. 10, 2006. This application also claims priority under 35 U.S.C. §119 of German Patent Application No. DE 10 2005 018 243.7, filed Apr. 19, 2005. Both the International Application and the German Application are incorporated herein by reference in their entireties.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The invention relates to a method for producing liquid preparations having a solid body content, in which the addition of at least a portion of the solid bodies takes place just before or during the pouring of a liquid preparation.

(2) Description of Related Art, Including Information Disclosed Under 37 C.F.R. §§1.97 and 1.98.

Many of the products that are used in everyday life are liquid preparations. In the field of detergents and cleaning compositions these are, for example, liquid detergents or fabric softeners; in the field of food preparations, for example, ready-made salad dressings or liquid tomato products such as ketchup; in the field of pharmaceutical preparations, for example, lotions or tinctures; in the cosmetics sector, for example, hair shampoos or shaving lotions; and in a further technical field, for example, liquid adhesives and varnishes or paints. This list could be continued indefinitely.

These liquid preparations frequently require a specific solid body content. The reasons for this are many and varied and depend on the intended use of the product. The reason may even be simply to emphasize the main visual features of a product, in order thereby to enhance its purely visual attractiveness to the consumer and in so doing facilitate his purchasing decision.

Thus, small colored particles may be incorporated, for example, in liquid detergents, the particles being suspended in the liquid detergent and not sinking, so that no sediment forms, and the particles do not float or cream. These particles may also contain specific active ingredients to make the product more effective. In such a case the particles would transmit a message to the consumer, such as "new and improved formulation." The consumer would directly be able to recognize the particles as the cause and identify the added value associated with them. In addition, sensitive substances, for example, can be worked into the liquid matrix via the particles. These sensitive substances are then protected so that incompatibilities between ingredients can be avoided.

The same considerations also apply to other technical fields—for example, it is possible to work into hair shampoos microcapsules which remain in the hair when the hair is washed and release their content, for example conditioning oils, to the hair only as a result of the rise in temperature occurring during the drying of the hair. User-friendly hair care can be achieved in this way. Likewise, flavorings in microencapsulated form, which are released only during cooking or in the course of mastication, can be introduced, for example, into liquid food preparations. Liquid preparations having a solid body content therefore permit "more intelligent" products with enhanced visual attractiveness and create possibilities for new formulations.

BRIEF SUMMARY OF THE INVENTION

However, the additional working of solid bodies into liquid preparations entails additional process engineering. Above all, it is desired to be able to continue using existing large-scale production facilities which to date have been geared, in particular, to the production of exclusively liquid preparations, so that no fundamentally new production facilities have to be built, as this would be too expensive. This is particularly the case, since the production of exclusively liquid products also has to continue on existing large-scale production facilities.

Therefore, if it is desired to use existing large-scale production facilities also for the production of liquid preparations containing solid bodies, two main problems have to be faced.

First, there is a risk of contamination, the risk that the production facility will be contaminated with solid bodies and that subsequent products in the production facility will be contaminated by solid bodies in zones known as "dead zones." Even minute amounts of the solid bodies here are sufficient to make very large amounts of the subsequent products unsaleable. The following scenario is an example of this: on one and the same production line a manual dishwashing detergent is first of all run with incorporation of freely suspended particles. Thereafter a liquid floor cleaning composition is run on the same production line. Residues of the freely suspended particles that are located in the facility enter the drums of the liquid floor cleaning composition as impurities. These contaminated compositions could not be offered to the trade, as the consumer would rightly regard them as contaminated. As a consequence, very thorough cleaning of the whole production facility would be required after each individual production run. This is difficult, because the solid bodies can easily remain attached to particularly inaccessible points, for example, in the pipelines, from which they can often be removed only after repeated flushing operations. It may even be necessary on occasions to dismantle entire pipeline systems, to clean them manually or mechanically, and re-assemble them. It may also be necessary to remove specific components, such as valves, and possibly renew them, since they can become clogged or leaky.

Second, there is a further risk that the solid bodies to be added will not survive the production line undamaged. This is due to the fact that the solid bodies are often by design exceptionally fragile, since the release of active ingredients contained in the solid bodies is to take place reliably and easily in the subsequent application, for example, through stimuli such as a slight rise in temperature or minor mechanical effects. The solid bodies are, however, obviously also exposed to such slight stimuli in existing production lines. Consequently, the integrity of a fair proportion of the solid bodies is already impaired at the production stage. This is highly regrettable in many respects. On the one hand, precisely those active ingredients that are incompatible with the rest of the formulation are preferably added to the solid bodies. If the incompatible active ingredient comes into contact with the rest of the formulation too early, namely at the production stage, then at best only the active ingredient will be destroyed, while in the worst case the whole of the formulation is affected, if not rendered unusable. Since the active ingredients to be added via the solids are generally of high quality and hence very expensive, their destruction is doubly disadvantageous.

To this is added the visual impairment if the solid bodies are, for example, damaged in form and shape, since they are, as it were, "shredded" during production. Very irregularly shaped, torn or frayed solid bodies can, for example, instead of enhancing the visual attractiveness of the product achieve exactly the opposite effect and produce in the consumer the feeling of being confronted with a lower quality product. This leads to major uncertainty in the consumer.

As a result of these problems, the benefits actually sought by working the solid bodies into the liquid preparations are levelled out again or even completely eliminated, or in the worst case reversed, for example, if the product becomes completely unusable.

The object of the present invention was, therefore, to overcome such problems.

This object is achieved by the subject of the invention, namely a method for producing a liquid preparation having a solid body content, in which the addition of at least a portion of the solid bodies takes place (a) only in the last method step preceding the pouring of the liquid preparation into a packing unit or (b) during the pouring into a packing unit, the liquid preparation advantageously having to be regarded as otherwise already ready for use prior to the addition of the solid bodies.

BRIEF DESCRIPTION OF THE SEVERAL VIEWS OF THE DRAWING(S)

Not Applicable

DETAILED DESCRIPTION OF THE INVENTION

In addition to overcoming the problems described in the introductory section, a further advantage of the method according to the invention is that it leads to liquid preparations in which the solid bodies are distributed highly homogeneously, in particular, if the mixing of solid body with liquid preparation does not take place until shortly before the pouring, in the last method stage preceding the pouring of the liquid preparation into a packing unit. In conventional standard processes the mixing actually takes place long before this, with the result that separation phenomena often occur in the piping systems in these cases.

By the term "liquid preparations" is meant liquid preparations in the widest sense, liquids with a pronounced thinly liquid consistency through to liquids with a pronounced doughy, viscous or mushy consistency, such as honey, ketchup, mustard or mayonnaise, to mention only a few specific examples. A liquid preparation in accordance with this invention is also called a "slurry," namely a preferably aqueous suspension of solids.

Liquid preparations in accordance with this invention also include gels, creams, pastes, sludges and slimes, In the very widest sense those preparations which do not flow at room temperature, but are spreadable, for example butter, shoe polish and cream cheese, are also liquid preparations in accordance with this invention.

Solid bodies in accordance with the present invention are substances which preferably possess both a substantially defined volume and preferably a substantially defined form and which preferably offer resistance to a change (deformation, reduction,) in their volume and/or their form. This resistance can be smaller, in the case of softer solid bodies, or greater, in the case of harder solid bodies. If a change in form takes place under external force, the solid bodies attempt to return to their original state again where possible. Solid bodies in accordance with this invention are preferably also dispersions or precipitations which may be present in liquids or as a moist material. A typical solid body in accordance with this invention is, for example, a capsule or what is known as a "speckle." Capsules and speckles are discussed in detail below.

The fact that the addition of at least a portion of the solid bodies takes place only in the last method step preceding the pouring of the liquid preparation into a packing unit means that after the completion of this method step substantially no further method steps follow and the liquid preparation is then poured into a packing unit. According to a preferred embodiment the fact that "substantially" no further method steps follow means that further components can still be added to the preparation containing solid bodies, for example, perfume, enzymes, flammable substances, readily ignitable substances, water and solvents, although this is a less preferred embodiment. It is more preferred not to add further components to the preparation containing solid bodies. According to a preferred embodiment the fact that "substantially" no further method steps follow also means that the preparation containing solid bodies can still be diluted or thickened, although this is a less preferred embodiment. It is more preferred not to further dilute or thicken the preparation containing solid bodies. In the narrowest and most preferred sense, the fact that "substantially" no further method steps follow means that, in fact, no further method steps follow other than the pouring of the preparation into packing units. This is the most preferred embodiment.

Other substances can obviously still be added to the liquid preparation during the addition of the solid bodies, such as, in particular, solvents, water, fragrances, enzymes, flammable substances and readily ignitable substances. This corresponds to a preferred embodiment.

The addition of the solid bodies "during the pouring into a packing unit" means that the solid bodies are added to the liquid preparation during the process of the filling of the packing unit. According to a preferred embodiment this can mean that the solid bodies are (at least in part) placed in the packing unit and the liquid preparation is added. According to a preferred embodiment, this can mean that the packing unit is charged with the liquid preparation and the solid bodies are finally added. (A good distribution of the solid bodies in the liquid preparation can then be obtained by shaking, swirling, turning, tipping or vibrating the packing unit.) According to a preferred embodiment this can mean that the packing unit is partially filled with the liquid preparation, the solid bodies are then added, and the unit is subsequently topped up with further liquid preparation. According to a preferred embodiment this can mean that solid bodies and liquid preparation are charged into the packing unit together, for example, in two streams, one stream of the liquid preparation and one stream of the solid bodies. According to a preferred embodiment, however, solid bodies and liquid preparation can, for example, also be added in one stream, liquid preparation and solid bodies are combined directly before the inlet into the packing unit and pass into the packing unit in one stream. This can be brought about, for example, by the solid bodies being blown into a liquid jet (jet of the liquid preparation) via a nozzle, whereby solid bodies and liquid preparation are combined with one another. This corresponds to a preferred embodiment.

The term "liquid preparation otherwise ready for use" means that in a specific preferred embodiment the liquid preparation that is to receive the solid bodies is preferably sufficiently ready for use that it could be poured directly into packagings, such as bottles or tubes, and where possible could thereafter be put to its intended use by the consumer, and that it therefore would not have to be subjected to any further mixing or blending process. According to a preferred embodiment, the term "liquid preparation otherwise ready for use" also covers the scenario where the addition to this liquid preparation of the elementally acting active ingredients occurs only with the addition of the solid bodies. A simplified example of this would be, for example, a partially thickened aqueous preparation which is free of active ingredients, and to which active ingredients are added only with the addition of the solid bodies. According to a preferred embodiment of this invention a partially thickened aqueous preparation of this type, which is free of active ingredients prior to the addition of the solid bodies, also represents a "liquid preparation otherwise ready for use."

The fact that "at least a portion of the solid bodies" must be added shortly before or during the pouring process means that it is not absolutely essential for the whole amount of the solid bodies contained in the liquid preparation to be added just before or during the pouring process. According to a preferred embodiment, for example, it is possible that a specific kind of solid bodies is already added to the liquid preparation beforehand. According to a preferred embodiment, for example, it is also possible that a single kind of solid bodies is added in portions, it being absolutely essential in this case that at least one portion is added just before the pouring process. It is particularly preferred, however, if the whole amount of the solid bodies is added just before or during the pouring process. This corresponds to a preferred embodiment of the invention.

The "pouring" of the preparation means preferably the filling of packing units, in particular individual packing units (for example, bottles, canisters, pouches,) with the liquid preparation. The latter can be used directly by the consumer. Packing units can also be containers, drums, pans, tanks or controlled release means; this is likewise preferred, although less preferred. The "pouring" of the preparation preferably takes place by weight and/or volume. The "pouring" of the preparation can also be performed via visual filling level monitoring. The visual filling level monitoring can be carried out by a person, for example, by a technical employee filling a packing unit (for example, a tank) and interrupting the supply of the liquid preparation into the tank as soon as the tank is nearly full. The visual filling level monitoring can however also be carried out semi-automatically or fully automatically, for example, by means of optical sensors, electronic filling level measurement, According to a further preferred embodiment of the invention the addition of at least a portion of the solid bodies takes place in the method only when the other components of the composition have already undergone a mixing process. In particular, they have already undergone all the steps required for the mixing or blending process, except for the substantially last step of the mixing with the solid bodies.

The blending of the liquid preparation otherwise ready for use, with the solid bodies to be added, advantageously takes place under mild conditions.

Mild conditions are, in particular, those which advantageously are not accompanied by major exposure to heat and/or preferably, are not accompanied by major mechanical stresses. Preferably the mixing takes place at temperatures of less than 70° C., advantageously, less than 60° C., in a more advantageous manner, less than 50° C., still more advantageously, less than 40° C., even more advantageously, still less than 30° C., in particular, at room temperature. Preferably, the specific output of the apparatus to be used for the mixing is less than 5 $kW/m^3$, preferably, less than 4 $kW/m^3$, advantageously, less than 3 $kW/m^3$, in a more advantageous manner, less than 2 $kW/m^3$, in an even more advantageous manner, less than 1 $kW/m^3$, in a still more advantageous manner, less than 0.8 $kW/m^3$, in a very advantageous manner, less than 0.6 $kW/m^3$, in an exceedingly advantageous manner, 0.4 $kW/m^3$, in particular, less than 0.2 $kW/m^3$.

The solid bodies to be added can advantageously be added continuously or discontinuously. It is, for example, possible that the solid bodies to be added are added to the liquid preparation with the aid of a carrier liquid preferably in suspended form. This corresponds to a preferred embodiment of the invention.

It is also possible that the solid bodies are added directly into the liquid preparation, preferably by dripping in or tipping in. This likewise corresponds to a preferred embodiment of the invention. Obviously it is also possible for a portion of the solid bodies to be added by means of a carrier liquid and another portion of the solid bodies to be added directly, for example, to be dripped in or tipped in.

The mixing of the aqueous preparation, otherwise ready for use, with the solid bodies to be added can advantageously take place in a continuous stirred-tank reactor (CST reactor). This corresponds to a preferred embodiment. A continuous stirred-tank reactor of this type is advantageously characterized by a continuous mode of operation and good, preferably almost complete, intermixing. Preferably, almost no concentration profiles and temperature profiles are to occur in the reactor, so that its content can preferably be described as virtually homogeneously mixed. If, therefore, the mixing of the otherwise ready-to-use preparations with the solid bodies to be added is carried out in a continuous stirred-tank reactor, this is a preferred embodiment.

However, other methods can obviously also be used for the blending or mixing, in particular, static mixing zones can be used, and this corresponds to a preferred embodiment.

A particularly suitable agitator for the mixing is, for example, an InterMig stirrer (produced by Ekato). Particularly suitable are agitators of the vane agitator, anchor stirrer, cross-arm paddle mixer, screw mixer or MIG agitator type. In order to avoid liquid rotation and achieve good homogenization in the continuously stirred tank, flow spoilers (reinforcements) can preferably be mounted in the tanks.

According to a preferred embodiment of the invention the mixing time (time for the blending of the solid bodies with the liquid preparation) is less than 60 minutes, advantageously, less than 50 minutes, in a more advantageous manner, less than 40 minutes, in a still more advantageous manner, less than 30 minutes, in a more advantageous manner, less than 20 minutes, in a very advantageous manner, less than 10 minutes, in a most advantageous manner, less than 5 minutes, preferably less than 4 minutes, in particular less than 3 minutes.

To be avoided are agitator types which are particularly suitable, for example, for emulsifying or suspending functions and therefore lead locally to a high shear input in the liquid. These include, for example, the propeller agitator, the impeller agitator and the disc agitator with agitation rates greater than 1 m/sec in viscous media (>500 mPa s). These are disadvantageous for the aims of the invention.

In particular, the following pumps are particularly suitable for the transport of the liquid preparations having a solid body content: Maso-Sinus pump, Rotan gear pump (one gear), hose pump with at least DN30.

In particular, the following pumps are less suitable, in particular, unsuitable, for the transport of the liquid preparations having a solid body content, since they can disadvantageously contribute to crushing of the solid bodies: gear pump (twin gear), centrifugal pump.

The method according to the invention is not subject to any limitation as far as the nature of the liquid preparation is concerned. Preferably the liquid preparation is a detergent and cleaning composition, a food preparation, a paint, dye or varnish preparation, an adhesive preparation, a pharmaceutical preparation and/or a cosmetic preparation. These mentioned preparations are preferred embodiments of the invention. Most particularly preferred are detergents and cleaning compositions and liquid cosmetic preparations. In accordance with the invention the liquid detergents include, in particular, also fabric softeners, as well as textile treatment compositions of all kinds.

The solid body content of the liquid preparation depends, in the final analysis, also on what purpose the preparation, and, in particular, also the solid bodies contained therein, is to serve. It may, therefore, be advantageous to work very large amounts of solid bodies into the liquid preparation. Likewise it may be advantageous to work in only moderate amounts of solid bodies or even very small amounts of solid bodies. Very small amounts of solid bodies are expedient, for example, if the active ingredient to be worked in with the solid body is, for example, very expensive or very effective.

It may be advantageous according to the invention if a specific maximum amount of solid bodies is not exceeded in the liquid preparation. If such a maximum amount is not exceeded, this is a preferred embodiment.

In a specific preferred embodiment the composition advantageously contains at most 80% by weight solid bodies, in a highly advantageous manner, at most 70% by weight solid bodies, in a more advantageous manner, at most 60% by weight solid bodies, in an even more advantageous manner, at most 50% by weight solid bodies, in an even more advantageous manner, still at most 40% by weight solid bodies, in a very advantageous manner, at most 30% by weight solid bodies, in a particularly advantageous manner, at most 25% by weight solid bodies, in a most particularly advantageous manner, at most 20% by weight solid bodies, in a substantially advantageous manner, at most 15% by weight solid bodies, in a highly substantially advantageous manner, at most 10% by weight solid bodies, in an extremely advantageous manner, at most 8% by weight solid bodies, in a most highly advantageous manner, at most 5% by weight solid bodies, in an exceedingly advantageous manner at most 4% by weight solid bodies, in an exceptionally advantageous manner, at most 3% by weight solid bodies, in a remarkably advantageous manner, at most 2% by weight solid bodies, in an extraordinarily advantageous manner, at most 1% by weight solid bodies, in particular, at most 0.07% by weight solid bodies, in a most advantageous manner, at most 0.05% by weight solid bodies.

It may also be advantageous according to the invention if the solid body content in the liquid preparation does not fall below a specific minimum amount. If the content does not fall below this maximum amount, a further preferred embodiment is involved.

In a specific preferred embodiment the composition advantageously contains at least 0.005% by weight solid bodies, in a highly advantageous manner, at least 0.01% by weight solid bodies, in a more advantageous manner, at least 0.03% by weight solid bodies, in an even more advantageous manner, at least 0.05% by weight solid bodies, in an even more advantageous manner, still at least 1% by weight solid bodies, in a very advantageous manner, at least 1.5% by weight solid bodies, in a particularly advantageous manner, at least 2% by weight solid bodies, in a most particularly advantageous manner, at least 2.5% by weight solid bodies, in a substantially advantageous manner, at least 3% by weight solid bodies, in a highly substantially advantageous manner, at least 4% by weight solid bodies, in an extremely advantageous manner, at least 5% by weight solid bodies, in a most highly advantageous manner, at least 8% by weight solid bodies, in an exceedingly advantageous manner, at least 10% by weight solid bodies, in an exceptionally advantageous manner, at least 15% by weight solid bodies, in a remarkably advantageous manner, at least 20% by weight solid bodies, in an extraordinarily advantageous manner, at least 25% by weight solid bodies, in particular, at least 30% by weight solid bodies, in a most advantageous manner, at least 35% by weight solid bodies.

According to another, likewise preferred embodiment it may, however, also be advantageous if solid body is contained in specific quantity ranges in the liquid preparation. If the composition contains solid bodies advantageously, in amounts of 0.01 to 80% by weight, in a considerably advantageous manner, in amounts of 0.02 to 70% by weight in a more advantageous manner, in amounts of 0.05 to 60% by weight, in an even more advantageous manner, in amounts of 0.1 to 50% by weight, in a still more advantageous manner, in amounts of 0.5 to 40% by weight, in a very advantageous manner, in amounts of 1 to 30% by weight, in a particularly advantageous manner, in amounts of 1.5 to 20% by weight, in a most particularly advantageous manner, in amounts of 2 to 10% by weight, in particular, in amounts of 3 to 7% by weight, then this is a preferred embodiment of the invention.

The benefits associated with the working of the solid bodies into the liquid preparation also include visual aspects, which help the product acquire an improved aesthetic appearance and are therefore advantageous for the overall attractiveness of the product.

Particularly positive associations are created by those preparations produced according to the invention in which the solid bodies exhibit a stable spatial arrangement with a uniform spatial distribution in the liquid preparation, in particular, are suspended therein. The solid bodies neither sink nor rise up. "Uniform spatial distribution" means that the solid bodies are not contained in very large amounts in specific parts by volume of the preparations and in very small amounts in other parts by volume. Instead, an approximately equal amount of solid bodies is contained in all parts by volume. This corresponds to a preferred embodiment. However, the advantage associated with this is not only of a visual nature, but also benefits the consumer at the application stage, during the dosing, since the solid bodies advantageously contain active ingredients. Thus, for example, a liquid detergent which contains active ingredients in solid bodies which do not exhibit a stable spatial arrangement would have to be shaken by the consumer prior to use (prior to dosing), in order to achieve a good distribution of the active ingredients in the liquid detergent. Otherwise one would run the risk that either too little or too much of the active ingredients contained in the solid bodies is added. If, on the other hand, the solid bodies exhibit a stable spatial arrangement with a uniform spatial distribution, for example, in a liquid detergent, the consumer can add the latter immediately without taking other measures.

The nature of the solid bodies to be added is basically not subject to any fundamental limitations. It is basically governed by what is to be introduced into the liquid preparation and in what form, and also by the way in which the solid body is to interact at the application stage.

Thus, for example, it is clear that different conditions are attached to a scouring cream, in which the incorporated solid bodies represent, for example, abrasive components, than, for example, to a salad dressing which contains, for example, microencapsulated flavorings.

In the one case the abrasive components must withstand relatively high mechanical stresses, and in the other case the microencapsulated flavorings must be released, for example, during the chewing process.

According to a preferred embodiment, however, it is advantageous if the incorporated solid bodies exhibit a high stability, preferably mechanical stability, and according to another advantageous embodiment, it is similarly preferable if they exhibit a low stability, preferably mechanical stability, or else that the stability, preferably mechanical stability, lies between these extremes.

The stability can relate to all physical and/or chemical and/or biological stresses. A physical stress is, for example, a mechanical stimulus, such as pressure or friction, or else a temperature change, A chemical stress is, for example, a pH value change, an ionic strength change, a change in the lipophilic or hydrophilic properties of the surrounding medium, A biological stress results, for example, from exposure to microorganisms, if microorganisms are allowed to act on the solid bodies or the like. The same applies to any other biological factors.

However, those solid bodies that are sensitive to mechanical stresses, in particular, shear-sensitive solid bodies, are particularly advantageous with respect to the present invention. Their use in the method according to the invention represents a preferred embodiment of the invention.

Solid bodies that are sensitive to mechanical stresses are, therefore, extremely suitable for many liquid preparations, because it is ensured in this way that the solid bodies lose their integrity virtually quantitatively at the application stage, and in so doing preferably release incorporated active ingredients, and hence fulfil their purpose.

The method according to the present invention contributes a remarkable improvement in this respect. To date it has only been possible to work in solid bodies that are at least mechanically sufficiently stable to withstand passage through a conventional production facility relatively undamaged. This resulted in great problems at the application stage, however. Thus, for example, it has been observed in many cases that solid bodies did not "dissolve" even at the actual application stage. The machine washing of laundry is a specific example. For example, it has been observed in some cases that the solid bodies, instead of "dissolving," were deposited intact on the textile fabric. This was disadvantageous in two respects. First, the valuable active ingredients preferably contained in the solid bodies had not been released during the washing process and were, therefore, unable to exert their effect, and second, the solid bodies were rightly perceived as impurities on the textile fabric. The washing machine can even be contaminated.

The present invention now makes it possible, conversely, to use even solid bodies that are extraordinarily sensitive to stresses and, in particular, to mechanical stresses. in particular are extraordinarily shear-sensitive. An advantage is that these extraordinarily sensitive solid bodies can now be worked without difficulty and preferably intact into the liquid preparations by means of the novel method. It is thereby ensured that the solid bodies concerned can in any case be "dissolved" at the actual application stage or lose their integrity.

Such methods according to the invention in which the solid bodies to be added are particularly sensitive to external stimuli, and are preferably sensitive to mechanical stresses, in particular, are shear-sensitive, therefore represent a preferred embodiment of the invention.

In order to ensure that the solid bodies to be added can be worked into the liquid preparation undamaged, it is advantageous if the addition of the solid bodies into the preparation and the mixing therewith take place under conditions with low shear. This corresponds to a preferred embodiment.

Likewise it is advantageous if the preparation, after the solid bodies have been added, is fed to the pouring stage under conditions with low shear. This corresponds to a preferred embodiment.

It is advantageous for the method according to the invention if the flow behavior of the liquid preparation, after addition of the solid bodies, is substantially accompanied, in the piping systems to be passed through subsequently, by Reynolds numbers up to 10,000, but preferably less than 2,300, advantageously less than 2,000, in particular less than 1,500. This corresponds to a preferred embodiment.

The Reynolds number (Re) is the characterizing number for the course of flow processes in preferably fully filled cavities (pipes): it defines the ratio of inertial forces to frictional forces in flowing liquids:

$$Re = \frac{2R \cdot \bar{v} \cdot \rho}{\eta} = \frac{w \cdot l}{v} = \frac{200Q}{\pi \cdot R \cdot k \cdot t^2}$$

In the equations R=radius of the pipe flowed through and l=diameter or characteristic length, $\bar{v}$=mean flow rate and w=characteristic rate, ρ=density of the liquid to be measured, η=dynamic viscosity, v=kinematic viscosity, Q=flowed through volume, k=equipment constant for viscometer without external pressure and t=flow time.

It is even more advantageous if the flow behavior of the liquid preparation, after addition of the solid bodies, is accompanied, in the piping systems to be passed through subsequently, by coefficients of friction up to 0.03, preferably, in the range of 0.03 to 0.1.

The coefficient of friction obeys the Darcy pressure loss equation as follows:

$$\lambda=(\Delta P \cdot d \cdot 2)/(l \cdot \rho \cdot u^2)$$

In the equation λ=coefficient of friction, ΔP=pressure loss in the pipe, d=diameter of the pipe, l=length of the pipe, ρ=density of the liquid, u=velocity.

To determine λ, there are, for example, also various empirical approaches. In the laminar flow range $\lambda=64/Re$ preferably applies. With Reynolds numbers in the range of 2,320 up to 10,000, $\lambda=0.3164/(Re^{0.25})$ applies. For Reynolds numbers<100,000, $\lambda=0.0054+0.396/Re^{0.3}$ applies according to Blasius. With laminar flow, λ is generally inversely proportional to Re, while in turbulent flow there is only a slight dependence.

Pressure losses in the piping system occur, however, not only in the pipe, but also in other components such as elbows, ells, flanges, valves, cocks, flaps, diaphragms, In contrast to the pipe these additional pressure losses are not distributed over the entire length. They are therefore known as "local pressure losses." The local pressure loss is represented by a coefficient $\zeta$ for determining the pressure loss: $\Delta\rho=\zeta\cdot 0.5\cdot\rho\cdot u^2$.

In the equation $\zeta$=coefficient of the individual resistances, $\Delta P$=pressure loss in the component, u=velocity, $\rho$=density of the liquid.

Coefficients of the individual resistances for various components can, for example, be taken from the literature, for example from K. F. Pawlow, P. C. Romankow, A. A. Noskow: Beispele und Übungsaufgaben zur chemischen Verfahrenstechnik (Examples and practical problems in chemical process engineering), VEB Deutscher Verlag für Grundstoffundustrie, 1979. Coefficients of the individual resistances generally lie between 0 (for example pipe enlargements) and 20 (for example valves), depending on the component.

For the present invention it is advantageous if the coefficients of the individual resistances of the components of the piping system, after addition of the solid bodies, are in the range of 0 to 20 per individual resistance, a summary value preferably, of 10, advantageously, of 7, in a more advantageous manner, of 5, in an even more advantageous manner, of 4, in a still more advantageous manner, of 3, in particular, of 2, not being exceeded.

The liquid preparation which is producible by the method according to the invention is basically not subject to any limitation as regards the nature of the liquid contained in it. It can therefore be composed of all kinds of liquids or solvents, A particularly preferred liquid in this connection is water. Water offers the advantages that it is clear, without taste or smell, colorless, available cheaply in large amounts, easily manageable and palatable, as well as ecologically sound.

Preferred liquid preparations are therefore aqueous compositions. This corresponds to a preferred embodiment. In the context of this invention an aqueous composition is preferably present if it contains at least 0.01% by weight water.

In a specific preferred embodiment the composition advantageously contains at least 1% by weight water, in a highly advantageous manner, at least 5% by weight water, in a more advantageous manner, at least 10% by weight water, in an even more advantageous manner, at least 15% by weight water, in a still more advantageous manner, at least 20% by weight water, in a very advantageous manner, at least 25% by weight water, in a particularly advantageous manner, at least 30% by weight water, in a most particularly advantageous manner, at least 35% by weight water, in a substantially advantageous manner, at least 40% by weight water, in a highly substantially advantageous manner, at least 45% by weight water, in an extremely advantageous manner, at least 50% by weight water, in a most highly advantageous manner, at least 55% by weight water, in an exceedingly advantageous manner, at least 60% by weight water, in an exceptionally advantageous manner, at least 65% by weight water, in a remarkably advantageous manner, at least 70% by weight water, in an extraordinarily advantageous manner, at least 75% by weight water, in particular, at least 80% by weight water, in a most advantageous manner, at least 85% by weight water.

According to another, likewise preferred, embodiment it may, however, also be advantageous that a specific upper limit of water is not exceeded. If the composition contains at most 95% by weight water, in a highly advantageous manner, at most 90% by weight water, in a more advantageous manner, at most 85% by weight water, in an even more advantageous manner, at most 80% by weight water, in a still more advantageous manner, at most 75% by weight water, in a very advantageous manner, at most 70% by weight water, in a particularly advantageous manner, at most 65% by weight water, in a most particularly advantageous manner, at most 60% by weight water, in a substantially advantageous manner, at most 55% by weight water, in a highly substantially advantageous manner, at most 50% by weight water, in an extremely advantageous manner, at most 45% by weight water, in a most highly advantageous manner, at most 40% by weight water, in an exceedingly advantageous manner, at most 35% by weight water, in an exceptionally advantageous manner, at most 30% by weight water, in a remarkably advantageous manner, at most 25% by weight water, in an extraordinarily advantageous manner, at most 20% by weight water, in particular at most 15% by weight water, in a most advantageous manner, at most 10% by weight water.

According to a further preferred embodiment the composition is anhydrous, contains less than 10% by weight, preferably less than 5% by weight, in a more advantageous manner, less than 3% by weight, even more advantageously, less than 1% by weight water, in particular, is completely anhydrous.

According to another, likewise preferred, embodiment it may, however, also be advantageous if water is contained in specific quantity ranges. If the composition contains water advantageously in amounts of 5 to 95% by weight, in a highly advantageous manner, in amounts of 10 to 90% by weight, in a more advantageous manner, in amounts of 15 to 85% by weight, in an even more advantageous manner, in amounts of 20 to 80% by weight, in a still more advantageous manner, in amounts of 25 to 75% by weight, in a very advantageous manner in amounts of 30 to 70% by weight, in a particularly advantageous manner, in amounts of 35 to 65% by weight, in a most particularly advantageous manner, in amounts of 40 to 60% by weight, in particular, in amounts of 45 to 55% by weight, this is a preferred embodiment.

As regards the size of the solid bodies to be added to the liquid preparation, substantially all conceivable sizes that make sense in the context of the specific application considered are possible here. Consequently, the solid bodies can exhibit a diameter along their greatest extension of preferably 0.01 to 20,000 μm, which corresponds to a preferred embodiment.

According to a further preferred embodiment however the solid bodies are smaller than 20,000 μm. If the solid body exhibits a diameter along its greatest extension of, at most 10,000 μm, in a highly advantageous manner, at most 9,000 μm, in a more advantageous manner, at most 8,000 μm, in an even more advantageous manner, at most 7,000 μm, in a still more advantageous manner, at most 6,000 μm, in a very advantageous manner, at most 5,000 μm, in a particularly advantageous manner, at most 4,000 μm, in a most particularly advantageous manner, at most 3,000 μm, in a substantially advantageous manner, at most 2,000 μm, in a most substantially advantageously manner, at most 1,000 μm, in an extremely advantageous manner, at most 500 μm, in the most highly advantageous manner, at most 400 μm, in an exceedingly advantageous manner, at most 300 μm, in an exceptionally advantageous manner, at most 200 μm, in a remarkably advantageous manner, at most 100 μm, in an extraordinarily advantageous manner, at most 50 μm, in particular, at most 10 μm, in a most advantageous manner, at most 1 μm, this is a preferred embodiment.

It may however advantageously also be desirable for specific applications if the solid bodies exhibit a specific minimum size. If the solid body, therefore, exhibits a diameter along its greatest extension of at least 0.1 μm, in a highly advantageous manner, at least 1 μm, in a more advantageous manner, at least 10 μm, in an even more advantageous manner, at least 100 μm, in a still more advantageous manner, at least 200 μm, in a very advantageous manner, at least 400 μm, in a particularly advantageous manner, at least 600 μm, in a most particularly advantageous manner, at least 800 μm, in a substantially advantageous manner, at least 1,000 μm, in a most substantially advantageous manner, at least 2,000 μm, in an extremely advantageous manner, at least 3,000 μm, in the most highly advantageous manner, at least 4,000 μm, in an exceedingly advantageous manner, at least 5,000 μm, in an exceptionally advantageous manner, at least 6,000 μm, in a remarkably advantageous manner, at least 7,000 μm, in an extraordinarily advantageous manner, at least 8,000 μm, in particular, at least 9,000 μm, in a most advantageous manner, at least 10,000 μm, this is again a preferred embodiment.

According to another, likewise preferred, embodiment, it may, however, also be advantageous if the solid body exhibits a diameter along its greatest extension which is contained in specific length ranges. If the composition contains solid bodies with a diameter along its greatest extension, advantageously of 1 to 10,000 μm, in a highly advantageous manner, in amounts of 10 to 9,000 μm, in a more advantageous manner, in amounts of 100 to 8,000 μm, in an even more advantageous manner, in amounts of 200 to 7,000 μm, in a still more advantageous manner, in amounts of 300 to 6,000 μm, in a very advantageous manner, in amounts of 400 to 5,000 μm, in a particularly advantageous manner, in amounts of 500 to 4,000 μm, in a most particularly advantageous manner, in amounts of 600 to 3,000 μm, in particular, in amounts of 700 to 2,000 μm, this is a preferred embodiment of the invention.

According to a further preferred embodiment it is advantageous if the solid bodies contained in the liquid preparation have a substantially globular or spherical shape.

For a stable make-up of the solid bodies in the liquid preparation, preferably a precise density setting of the solid bodies is advantageous, for example, via hollow microspheres (see below), in order to prevent even more reliably a subsequent floating up and/or sinking of the capsules in the detergent.

In accordance with a further preferred embodiment it is likewise advantageous if the solid bodies contained in the liquid preparation exhibit a narrow particle size spectrum, which is the case, in particular, if the particle size distribution of the solid bodies is such that the ratio of $d_{50}$ to $d_{90}$ of the solid bodies is substantially at least 0.5, preferably, at least 0.6, advantageously, at least 0.75, in a more advantageous manner, at least 0.8 and, in particular, at least 0.9, where $d_{50}$ represents the median value. The median value is defined as that particle size below and above which 50% of the amount of particles respectively lie. Accordingly with $d_{90}$, 90% of the amount of particles lies below the value, 10% above it. The ratio $d_{50}/d_{90}$ approximates to the value of 1 with very narrow particle size distributions, and lies significantly below 0.5 with wide distributions.

According to a further preferred embodiment, the solid bodies exhibit substantially a mean shape factor of at least 0.77, preferably, of at least 0.79, advantageously, of at least 0.83, in particular, of at least 0.87. "Substantially" herein means, in particular, that at least 80%, preferably, at least 90%, and in a more advantageous manner, at least 95% of the solid bodies exhibit the above-mentioned shape factor.

The shape factor in accordance with the present invention can be determined precisely by modern particle measuring techniques with digital image processing. Typical particle shape analysis, such as can be performed with the Camsizer® system of Retsch Technology or with the KeSizer® system of Kemira, is based on the fact that the particles or solid bodies are irradiated with a light source and the particles are detected, digitized and processed by computer as projection surfaces. The surface curvature is determined using an optical measuring system in which the "shadow cast" by the parts to be tested is determined and is converted into a corresponding shape factor. The basic principle for determining the shape factor has been described, for example, by Gordon Rittenhouse in "A visual method of estimating two-dimensional sphericity" in the Journal of Sedimentary Petrology, Vol. 13, No. 2, pp. 79-81. It is also possible to obtain the numerical values for $d_{50}$ and $d_{90}$ by the above-mentioned measuring method.

If the solid bodies are capsules, microcapsules or speckles, this is a preferred embodiment. The solid bodies can, however, also be agglomerates or granules. The solid bodies can also be grains, for example, in the manner of grains of sand or grains of rice. The solid bodies can also be scraps or have a film structure.

Capsules are in the widest sense all those structures in which solid, semi-solid or liquid substances are surrounded by encasing layers. The encasing layers can be composed of any possible substances, for example, of gelatin, wax, (co) polymers or wafer materials. The production of capsules is known to the skilled person or can be derived from the relevant literature. A capsule can comprise a plurality of encasing layers.

Advantageously, "microencapsulation" is the term for the encapsulation, preferably, of finely-dispersed liquid or solid phases by coating with film-forming (co)polymers that are deposited on the material to be encased, for example, after emulsification and coacervation or interfacial polymerization. The microscopically small capsules (synonym: "nanocapsules") can be dried like powder. In this way, for example, gasoline, water, alcohol, pharmaceuticals, solvents, vitamins, enzymes, liquid crystals, food flavorings, perfumes and many other substances can be converted into a solid that cannot dry out and of which the content if necessary becomes free (liquid) again through thermal, mechanical, chemical or enzymatic action.

By the term "microcapsules" are therefore meant preferably aggregates that contain at least a solid, semi-solid or liquid core that is enclosed by at least one preferably continuous shell, in particular, a shell of polymer(s). Conventionally these are finely-dispersed liquid or solid body phases coated with film-forming polymers, for the manufacture of which the polymers are deposited on the material to be coated after emulsification and coacervation or interfacial polymerization. The microscopically small capsules can be dried like powder. In addition to single-core microcapsules, multi-core aggregates, also called microspheres, are also known, which contain two or more cores distributed in the continuous shell material. Single- or multi-core microcapsules can also be enclosed by an additional second, third, shell. Single-core microcapsules with a continuous shell are preferred. The shell can consist of natural, semi-synthetic or synthetic materials. Natural shell materials include, for example, gum arabic, agar, agarose, maltodextrins, alginic acid and its salts, for example, sodium or calcium alginate, fats and fatty acids, hexadecan-1-ol, collagen, chitosan, lecithin, gelatin, albumin, shellac, polysaccharides such as starch or dextran, sucrose and waxes. Semi-synthetic shell materials are chemically modified celluloses, in particular, cellulose esters and ethers, for example, cellulose acetate, ethylcellulose, hydroxypropylcellulose, hydroxypropylmethylcellulose and carboxy-methylcellulose, as well as starch derivatives, in particular starch ethers and esters. Synthetic shell materials are, for example, polymers such as polyacrylates, polyamides, polyvinyl alcohol or polyvinyl pyrrolidone.

Sensitive, chemically or physically incompatible, as well as volatile components (=active ingredients) can preferably be contained in the interior of the solid bodies, in particular, capsules, microcapsules or speckles, so as to be stable in storage and transport. The solid bodies can contain, for example, optical brighteners, surfactants, complexing agents, bleaching agents, bleach activators, dyes and fragrances, antioxidants, builders, enzymes, enzyme stabilizers, antimicrobial agents, cationic surfactants, vitamins, proteins, preservatives, detergency boosters or pearlescence imparters, antigreying agents, antiredeposition agents, pH adjusters, electrolytes, suds suppressors and UV absorbers, to name individual specific examples that are relevant, in particular, in the context of detergents and cleaning compositions. The fillings of the solid bodies can preferably be solids or liquids in the form of solutions or emulsions or suspensions.

The microcapsules are obtainable by methods known in the prior art, the greatest importance being attached to coacervation and interfacial polymerization. Suitable microcapsules include any commercially available surfactant-stable microcapsules, for example the trade products (the shell material is given in parentheses in each case) (gelatin, gum arabic), (maritimes Collagen), (alginic acid, agar), (lactose, microcrystalline cellulose, hydroxypropyl-methylcellulose); (lactose, microcrystalline cellulose, hydroxy-propylmethylcellulose); (modified starch, fatty acid esters, phospholipids), (modified agar) and (phospholipids).

Alternatively, particles can also be used which do not exhibit a core-shell structure, but in which the active ingredient is distributed in a matrix of a matrix-building material. Such particles are also described as "speckles."

A preferred matrix-building material is alginate. To produce alginate-based speckles, an aqueous alginate solution, which preferably also contains the active ingredient to be included or the active ingredients to be included, is converted into droplets and then cured in a $Ca^{2+}$ ions- or $Al^{3+}$ ions-containing precipitating bath. In a specific embodiment of the present invention the precipitating bath has a $Ca^{2+}$ concentration of at least 0.15 mol/l.

It may be advantageous that the alginate-based speckles are thereafter washed with water and then washed in an aqueous solution with a complexing agent, in order to wash out free $Ca^{2+}$ ions or free $Al^{3+}$ ions, which can undergo undesirable interactions with components of the liquid preparation. The alginate-based speckles are then washed once again with water in order to remove superfluous complexing agents.

Alternatively, other matrix-forming materials can be used instead of alginate. Examples of matrix-forming materials include polyethylene glycol, polyvinylpyrrolidone, polymethacrylate, polylysin, poloxamer, polyvinyl alcohol, polyacrylic acid, polyethylene oxide, polyethoxyoxazoline, albumin, gelatin, acacia, chitosan, cellulose, dextran, Ficoll®, starch, hydroxyethylcellulose, hydroxypropylcellulose, hydroxypropylmethylcellulose, hyaluronic acid, carboxymethylcellulose, carboxymethylcellulose, deacetylated chitosan, dextransulfate and derivatives of these materials. The matrix formation takes place with these materials, for example, via gelation, polyanion-polycation interactions or polyelectrolyte-metal ion interactions and is equally well known in the prior art as the production of particles with these matrix-forming materials.

The solid bodies can preferably be dispersed stably in the liquid preparations. "Stably" means that the compositions are stable at room temperature and at 40° C. over a period of at least 4 weeks and preferably of at least 6 weeks, without the compositions creaming or precipitating. It is an important advantage of the present invention in this context that extraordinarily stable preparations can be prepared by the method according to the invention. The preparations are, in particular, so stable because, with the working-in according to the invention, the solid bodies can be incorporated substantially completely intact into the preparation. Such substantially intact solid bodies are obviously far more stable than ones that have already suffered damage to shape and integrity at the production stage of the preparation. It follows from this that the whole preparation becomes even more stable, in particular, as regards storage and transport.

The release of the active ingredients from the solid bodies conventionally takes place during the application of the compositions containing them, by destruction of the shell or the matrix, preferably as the result of mechanical, thermal, chemical or enzymatic action.

In a preferred embodiment the solid bodies additionally contain at least one hollow microsphere.

Hollow microspheres have a diameter preferably of 2 to 500 μm, in particular, of 5 to 20 μm, and a specific gravity preferably of less than 1 g/cm$^3$. By working one or more hollow microspheres into the respective solid bodies, the density of the solid bodies can be adjusted to the density of the surrounding preparation, and thus undesirable sinking and floating up (creaming) of the capsules be prevented.

Preferably the hollow microspheres are round and smooth. The hollow microspheres can be made from inorganic material such as water glass, aluminium silicate, borosilicate glass, soda-lime glass or a ceramic or from organic polymers such as, for example, homo- or copolymers of styrene, acrylonitrile and vinylidene chloride. Suitable hollow microspheres are commercially available, for example, under the names Fillite® (ex Trelleborg Fillite), Expancel® (ex Akzo Nobel), Scotchlite® (ex 3M), Dualite® (ex Sovereign Speciality Chemicals), Sphericel® (ex Potters Industries), Zeeospheres (ex 3M), Q-Cel® (ex PQ Corporation) or Extendospheres® (ex PQ Corporation). Further suitable hollow microspheres are offered under the product name E-Spheres by OMEGA MINERALS. E-Spheres are white, ceramic hollow microspheres which are offered in different grain sizes, grain size distributions, bulk densities and bulk volumes. Many of the above-mentioned hollow microspheres are chemically inert and after destruction of the capsule are dispersed in the washing liquor and then discarded therewith.

In particular, with regard to the respective application envisaged, it may be advantageous if the viscosity of the preparation falls below specific values. The viscosity of the liquid preparation can be measured by conventional standard methods (for example, Brookfield viscometer LVT-II at 20 rpm and 20° C., spindle 3).

If the viscosity of the preparation has a value of at most 2,0000 mPas, in a highly advantageous manner, at most 15,000 mPas, in a more advantageous manner, at most 10,000 mPas, in an even more advantageous manner, at most 9,000 mPas, in a still more advantageous manner, at most 8,000 mPas, in a very advantageous manner, at most 7,000 mPas, in a particularly advantageous manner, at most 6,000 mPas, in a most particularly advantageous manner, at most 5,000 mPas, in a substantially advantageous manner, at most 4,000 mPas, in a most substantially advantageous manner, at most 3,000 mPas, in an extremely advantageous manner, at most 2,000 mPas, in particular, at most 1,000 mPas, this is a preferred embodiment.

With a view to the subsequent application, on the other hand, it may be just as advantageous if the viscosity of the preparation exceeds specific values. If, therefore, the viscosity is a value of at least 0.1 mPas, in a highly advantageous manner, at least 1 mPas, in a more advantageous manner, at least 10 mPas, in an even more advantageous manner, at least 100 mPas, in a still more advantageous manner, at least 200 mPas, in a very advantageous manner, at least 300 mPas, in a particularly advantageous manner, at least 400 mPas, in a most particularly advantageous manner, at least 500 mPas, in a substantially advantageous manner, at least 600 mPas, in a most substantially advantageously manner, at least 700 mPas, in an extremely advantageous manner, at least 800 mPas, in a most highly advantageous manner, at least 900 mPas, in an exceedingly advantageous manner, at least 1,000 mPas, in an exceptionally advantageous manner, at least 1,200 mPas, in a remarkably advantageous manner, at least 1,400 mPas, in an extraordinarily advantageous manner, at least 1,500 mPas, in particular at least 1,700 mPas, in a most advantageous manner, at least 2,000 mPas, this is again another, likewise preferred, embodiment.

According to another, likewise preferred, embodiment it may however also be advantageous if the preparation exhibits a viscosity which lies in specific ranges. If the preparation has a viscosity in an advantageous manner of 10 to 10,000 mPas, in a highly advantageous manner, in amounts of 200 to 9,000 mPas, in a more advantageous manner, in amounts of 300 to 8,000 mPas, in an even more advantageous manner, in amounts of 400 to 7,000 mPas, in a still more advantageous manner, in amounts of 500 to 6,000 mPas, in a very advantageous manner, in amounts of 1,000 to 5,000 mPas, in a particularly advantageous manner, in amounts of 1,500 to 4,500 mPas, in a most particularly advantageous manner, in amounts of 1,800 to 4,200 mPas, in particular, in amounts of 2,000 to 4,000 mPas, this is a preferred embodiment of the invention.

Advantageously the preparation according to the invention also contains thickeners. Thickeners are preferably organic, high-molecular materials that preferably soak up liquids (generally water), advantageously at the same time swell up (swelling) and finally (except for the inorganic thickeners) preferably pass into viscous genuine or colloidal solutions. Thickeners are preferably used to increase the viscosity of liquids or to improve the thixotropic properties of gels. Thickeners, therefore, play a part in the production of many industrial, cosmetic, pharmaceutical or dietetic preparations and of foodstuffs (which are all considered in the context of the invention), for example, of creams, cleaning compositions, dressings, printing inks, paint dispersions, adhesives, puddings, slimming aids (the organic thickeners are preferably edible, but often have no nutrient value).

According to a preferred embodiment the preparation to be produced according to the invention therefore contains thickeners, in particular, selected from at least one of the following groups:

a) organic, natural thickeners (herein, more particularly, substances such as agar, carrageenan, tragacanth, gum arabic, alginates, pectins, polyoses, guar meal, carob bean flour, starch, dextrins, gelatin, casein,),
b) organic, modified natural substances (herein, more particularly, substances such as carboxymethylcellulose and other cellulose ethers, ethylhydroxyethylcellulose, hydroxyethylcellulose, hydroxypropylmethylcellulose and hydroxypropylcellulose, prime flour ethers),
c) organic, fully synthetic thickeners (here, preferably, polyacrylic and polymethacrylic compounds, polyvinyl alcohols, polyacrylamides, polyvinylpyrrolidone, polyethylene glycols, vinyl polymers, polycarboxylic acids, styrene-maleic anhydride copolymers and their salts, polyethers, polyimines, polyamides and, in particular, the co- and ter-polymers of acrylic and methacrylic acid),
d) inorganic thickeners (herein, more particularly, polysilicic acids, clay minerals such as montmorillonite, hectorite, zeolites, silicas,),
e) low-molecular, organic products (herein, more particularly, metal soaps, hardened castor oil, modified fat derivatives, polyamides,) and
e) associative thickeners.

Associative thickeners differ, for example, from the above-mentioned modified natural substances and the organic, fully synthetic thickeners in that they preferably contain in the molecule, in addition to water-solubilizing hydrophilic groups, advantageously also hydrophobic terminal or side groups. Associative thickeners therefore advantageously acquire a surfactant character and are preferably capable of forming micelles. Particularly preferred associative thickeners are a) hydrophobically modified polyacrylates which preferably contain in an anion-active acrylate thickener molecule, nonionic hydrophilic and hydrophobic groups which are incorporated by copolymerization; b) hydrophobically modified cellulose ethers, preferably prepared by reaction of hydroxyethylcellulose during the etherification or subsequently with long-chain alkyl epoxides or halides; c) hydrophobically modified polyacrylamides, preferably produced by copolymerization of acrylamide with alkyl-modified acrylamide and optionally acrylic acid; d) hydrophobically modified polyethers; e) associative polyurethane thickeners, preferably consisting of hydrophilic, relatively high-molecular polyether segments linked by urethane groups, advantageously masked with at least two terminal, hydrophobic molecule groups.

The thickener can therefore include, for example, a polyacrylate thickener, xanthan gum, Gellan gum, guar flour, alginate, carrageenan, carboxymethylcellulose, bentonite, Wellan gum, carob seed flour, agar, tragacanth, gum arabic, pectins, polyoses, starch, dextrin, gelatin and casein.

The polyacrylic and polymethacrylic thickeners include, for example, the high-molecular homopolymers of acrylic acid (INCI designation according to "International Dictionary of Cosmetic Ingredients" of "The Cosmetic, Toiletry and Fragrance Association (CTFA)" Carbomer) crosslinked with a polyalkenylpolyether, in particular, an allyl ether of saccharose, pentaerythritol or propylene, which are also described as carboxyvinyl polymers. Such polyacrylic acids are obtainable from 3V Sigma under the trade name Polygel®, for example, Polygel DA, and from B. F. Goodrich under the trade name Carbopol®, for example, Carbopol 940 (molecular weight approximately 4,000,000), Carbopol 941 (molecular weight approximately 1,250,000) or Carbopol 934 (molecular weight 3,000,000). The following acrylic acid copolymers are also included among the latter: (i) copolymers of two or more monomers from the group of acrylic acid, methacrylic acid and their simple esters, preferably formed with $C_{1-4}$ alkanols, esters (INCI acrylates copolymer), which include, for example, the copolymers of methacrylic acid, butyl acrylate and methylmethacrylate (CAS designation according to Chemical Abstracts Service: 25035-69-2) or of butyl acrylate and methylmethacrylate (CAS 25852-37-3) and which are available, for example, from Rohm & Haas under the trade names Aculyn® and Acusol® and from Degussa (Goldschmidt) under the trade name Tego® Polymer, for example the anionic non-associative polymers Aculyn 22, Aculyn 28, Aculyn 33 (crosslinked), Acusol 810, Acusol 820, Acusol 823 and Acusol 830 (CAS 25852-37-3); (ii) crosslinked high-molecular acrylic acid copolymers, which include, for example, the copolymers of $C_{10-30}$ alkyl acrylates crosslinked with an allyl ether of saccharose or pentaerythritol, with one or more monomers from the group of acrylic acid, methacrylic acid and their simple esters (INCI acrylates/$C_{10-30}$ alkyl acrylate crosspolymer), preferably formed with $C_{1-4}$ alkanols, and which are obtainable, for example, from B.F Goodrich under the trade name Carbopol®, for example, the hydrophobized Carbopol ETD 2623 and Carbopol 1382 (INCI Acrylates/$C_{10-30}$ alkyl acrylate crosspolymer) and Carbopol Aqua 30 (previously Carbopol EX 473).

A further preferably used polymeric thickener is xanthan gum, a microbial anionic heteropolysaccharide which is produced from *Xanthomonas campestris* and some other species under aerobic conditions and has a molar mass of 2 to 15 million Dalton. Xanthan is formed from a chain with β-1,4-bonded glucose (cellulose) with side chains. The structure of the sub-groups consists of glucose, mannose, glucuronic acid, acetate and pyruvate, in which the number of the pyruvate units determines the viscosity of the xanthan gum.

The preparations to be produced according to the invention contain, depending on the purpose they are to serve, accordingly appropriate ingredients, which are familiar to the particular skilled person or are available from the relevant specialist literature. Liquid foodstuffs contain, for example, edible ingredients.

Particularly preferred preparations according to the present invention are those from the area of detergents and cleaning compositions, which also include fabric softeners and textile treatment agents in the widest sense.

In addition to the solid bodies, the liquid detergents and cleaning compositions to be produced according to the invention contain surfactant(s), it being possible to use anionic, nonionic, cationic and/or amphoteric surfactants. Preferred from an application point of view are mixtures of anionic and nonionic surfactants. The total surfactant content of a preferred liquid detergent and cleaning composition is preferably less than 40% by weight and particularly preferably less than 35% by weight, based on the total liquid detergent and cleaning composition.

Preferred nonionic surfactants include alkoxylated, advantageously ethoxylated, in particular, primary alcohols preferably containing 8 to 18 carbon atoms and on average 1 to 12 moles of ethylene oxide (EO) per mole of alcohol, in which the alcohol group can be linear or preferably methyl-branched in the 2-position or can contain linear and methyl-branched groups in the mixture, such as are conventionally present in oxoalcohol groups. In particular, however, alcohol ethoxylates with linear groups from alcohols of native origin containing 12 to 18 carbon atoms, for example, from coconut, palm, tallow fat or oleyl alcohol, and on average 2 to 8 EO per mole of alcohol, are preferred. The preferred ethoxylated alcohols include, for example $C_{12-14}$ alcohols with 3 EO, 4 EO or 7 EO, $C_{9-11}$ alcohol with 7 EO, $C_{13-15}$ alcohols with 3 EO, 5 EO, 7 EO or 8 EO, $C_{12-18}$ alcohols with 3 EO, 5 EO or 7 EO and mixtures thereof, such as mixtures of $C_{12-14}$ alcohol with 3 EO and $C_{12-18}$ alcohol with 7 EO. The stated degrees of ethoxylation represent statistical mean values which can be an integer or a fractional number for a specific product. Preferred alcohol ethoxylates exhibit a narrow homolog distribution (narrow range ethoxylates, NRE). In addition to these nonionic surfactants, fatty alcohols with more than 12 EO can also be used. Examples of these include tallow fat alcohol with 14 EO, 25 EO, 30 EO or 40 EO. Nonionic surfactants that contain EO and PO groups together in the molecule are also usable according to the invention. In this case block copolymers having EO-PO block units or PO-EO block units can be used, and also EO-PO-EO copolymers or PO-EO-PO copolymers. Mixed alkoxylated nonionic surfactants in which EO and PO units are distributed not blockwise but randomly are obviously also usable. Such products are obtainable by the simultaneous action of ethylene oxide and propylene oxide on fatty alcohols.

In addition, further nonionic surfactants also include alkyl glycosides of the general formula $RO(G)_x$, in which R represents a primary straight-chain or methyl-branched, in particular, methyl-branched in 2-position, aliphatic group with 8 to 22, preferably 12 to 18 carbon atoms and G is the symbol that represents a glycose unit with 5 or 6 carbon atoms, preferably glucose. The degree of oligomerization x, which specifies the distribution of monoglycosides and oligoglycosides, is any number between 1 and 10; preferably x is from 1.2 to 1.4.

A further class of preferred nonionic surfactants that can be used either as a single nonionic surfactant, or in combination with other nonionic surfactants, includes alkoxylated, preferably ethoxylated or ethoxylated and propoxylated fatty acid alkyl esters, preferably with 1 to 4 carbon atoms in the alkyl chain, in particular, fatty acid methyl esters, such as are described, for example, in Japanese Patent Application No. JP 58/217598 or which are preferably produced by the method described in International Patent Application WO-A-90/13533.

Nonionic surfactants of the amine oxide type, for example N-coconut alkyl-N,N-di-methylamine oxide and N-tallow alkyl-N,N-dihydroxyethylamine oxide, and the fatty acid alkanolamides, may be suitable. The amount of these nonionic surfactants is preferably not more than that of the ethoxylated fatty alcohols, in particular, not more than half of them.

Other suitable surfactants are polyhydroxy fatty acid amides of formula (1):

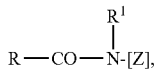

(1)

in which RCO represents an aliphatic acyl group containing 6 to 22 carbon atoms, $R^1$ represents hydrogen, an alkyl or hydroxyalkyl group with 1 to 4 carbon atoms and [Z] for a linear or branched polyhydroxyalkyl group with 3 to 10 carbon atoms and 3 to 10 hydroxyl groups. The polyhydroxy fatty acid amides are known substances which can be obtained conventionally by reductive amination of a reducing sugar with ammonia, an alkylamine or an alkanolamine and subsequent acylation with a fatty acid, a fatty acid alkyl ester or a fatty acid chloride.

The group of the polyhydroxy fatty acid amides also includes compounds of formula (2),

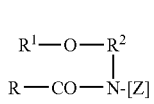

(2)

in which R represents a linear or branched alkyl or alkenyl group with 7 to 12 carbon atoms, $R^1$ represents a linear, branched or cyclic alkyl group or an aryl group with 2 to 8 carbon atoms and $R^2$ represents a linear, branched or cyclic alkyl group or an aryl group or an oxy-alkyl group with 1 to 8 carbon atoms, $C_{1-4}$ alkyl or phenyl groups being preferred, and [Z] represents a linear polyhydroxy alkyl group of which the alkyl chain is substituted with at least two hydroxyl groups, or alkoxylated, preferably ethoxylated or propoxylated derivatives of this group.

[Z] is preferably obtained by reductive amination of a sugar, for example, glucose, fructose, maltose, lactose, galactose, mannose or xylose. The N-alkoxy or N-aryloxy-substituted compounds can then, for example, according to the teaching of International Application No. WO-A-95/07331, be converted into the desired polyhydroxy fatty acid amides by reacting with fatty acid methyl esters in the presence of an alkoxide as a catalyst.

The content of nonionic surfactants of a preferred liquid detergent and cleaning composition is, preferably, 5 to 30% by weight, preferably, 7 to 20% by weight, and in particular, 9 to 15% by weight, based in each case on the composition as a whole.

Used as anionic surfactants, for example, are those of the sulfonate and sulfate type. Suitable surfactants of the sulfonate type preferably include $C_{9-13}$ alkylbenzenesulfonates, olefinsulfonates, mixtures of alkene- and hydroxy-alkanesulfonates as well as disulfonates, of the type obtained for example from $C_{12-18}$ monoolefins with a terminal or inner double bond by sulfonation with gaseous sulfur trioxide and subsequent alkaline or acid hydrolysis of the sulfonation products. Suitable also are alkanesulfonates that are obtained from $C_{12-18}$ alkanes, for example, by sulfochlorination or sulfoxidation with subsequent hydrolysis or neutralization. Equally suitable are also the esters of α-sulfofatty acids (ester sulfonates), for example, the α-sulfonated methyl esters of hydrogenated coconut, palm kernel or tallow fatty acids.

Other suitable anionic surfactants are sulfonated fatty acid glycerol esters. By fatty acid glycerol esters are to be understood the mono-, di- and triesters and mixtures thereof, of the type obtained during the production by esterification of a monoglycerol with 1 to 3 moles of fatty acid or during the transesterification of triglycerides with 0.3 to 2 moles of glycerol. Preferred sulfonated fatty acid glycerol esters are the sulfonation products of saturated fatty acids containing 6 to 22 carbon atoms, for example, of caproic acid, caprylic acid, capric acid, myristic acid, lauric acid, palmitic acid, stearic acid or behenic acid.

Preferred as alk(en)yl sulfates are the alkali and, in particular, the sodium salts of the sulfuric acid half-esters of the $C_{12}$-$C_{18}$ fatty alcohols, for example, from coconut fat alcohol, tallow fat alcohol, lauryl, myristyl, cetyl or stearyl alcohol or from the $C_{10}$-$C_{20}$ oxoalcohols, and those half-esters of secondary alcohols of these chain lengths. Further preferred are alk(ene)sulfates of the above-mentioned chain length, which contain a synthetic, straight-chain alkyl group produced on a petrochemical base, which possess similar decomposition characteristics to the suitable compounds based on fat-chemical raw materials. The $C_{12}$-$C_{16}$ alkyl sulfates and $C_{12}$-$C_{15}$ alkyl sulfates, as well as $C_{14}$-$C_{15}$ alkyl sulfates, are preferred on washing technology grounds. 2,3-alkyl sulfates, which are produced, for example, according to U.S. Pat. No. 3,234,258 or 5,075,041 and can be obtained as trade products of the Shell Oil Company under the name DAN®, are also suitable anionic surfactants.

The sulfuric acid monoesters of the straight-chain or branched $C_{7-21}$ alcohols ethoxylated with 1 to 6 moles of ethylene oxide, such as 2-methyl-branched $C_{9-11}$ alcohols with on average 3.5 moles of ethylene oxide (EO) or $C_{12-18}$ fatty alcohols with 1 to 4 EO, are also suitable. Because of their high sudsing characteristics, they are preferably used in cleaning compositions only in relatively small amounts, for example, in amounts of 1 to 5% by weight.

Other suitable anionic surfactants include the salts of alkylsulfosuccinic acid, which are also described as sulfosuccinates or as sulfosuccinic acid esters and which represent monoesters and/or diesters of sulfosuccinic acid with alcohols, preferably fatty alcohols and, in particular, ethoxylated fatty alcohols. Preferred sulfosuccinates contain $C_{8-18}$ fatty alcohol groups or mixtures thereof. Particularly preferred sulfosuccinates contain a fatty alcohol group that is derived from ethoxylated fatty alcohols, which represent on their merits nonionic surfactants (see description below). Sulfosuccinates, of which the fatty alcohol groups are derived from ethoxylated fatty alcohols with restricted homolog distribution, are in turn particularly preferred here. Equally it is also possible to use alk(en)ylsuccinic acid, preferably with 8 to 18 carbon atoms in the alk(en)yl chain or its salts.

Soaps are particularly preferred anionic surfactants. Saturated and unsaturated fatty acid soaps are suitable, such as the salts of lauric acid, myristic acid, palmitic acid, stearic acid, (hydrogenated) erucic acid and behenic acid, and, in particular, soap mixtures derived from natural fatty acids, for example, coconut, palm kernel, olive oil and tallow fat acids.

The anionic surfactants including the soaps can be in the form of their sodium, potassium or ammonium salts and as soluble salts of organic bases, such as mono-, di- or triethanolamine. Preferably the anionic surfactants are present in the form of their sodium or potassium salts, in particular, in the form of the sodium salts.

The content of anionic surfactants in preferred liquid detergents and cleaning compositions is 2 to 30% by weight, preferably, 4 to 25% by weight and, in particular, 5 to 22% by weight, based in each case on the composition as a whole.

In addition to the solid bodies, preferred liquid detergents and cleaning compositions can contain further ingredients which further improve the application and/or aesthetic properties of the liquid detergent and cleaning composition. In the context of the present invention, preferred compositions also contain one or more substances from the group of builders, bleaching agents, bleach activators, enzymes, electrolytes, non-aqueous solvents, pH adjusters, fragrances, perfume carriers, fluorescence agents, dyes, hydrotropes, suds suppressors, silicone oils, antiredeposition agents, optical brighteners, anti-greying agents, shrinkage preventers, crease-proofing agents, color transfer inhibitors, antimicrobial agents, germicides, fungicides, antioxidants, corrosion inhibitors, antistatics, ironing aids, repelling and impregnating agents, anti-swell and anti-slip agents, as well as UV absorbers.

Builders that can be contained in the liquid detergents and cleaning compositions include, in particular, silicates, aluminium silicates (in particular zeolites), carbonates, salts of organic di- and polycarboxylic acids as well as mixtures of these substances.

Suitable crystalline, layered sodium silicates possess the general formula $NaMSi_xO_{2x+1}H_2O$, in which M represents sodium or hydrogen, x is a number from 1.9 to 4 and y a number from 0 to 20, and preferred values for x are 2, 3 or 4. Crystalline layered silicates of this kind are disclosed for example in European patent application EP-A-0 164 514. Preferred crystalline layered silicates of the stated formula are those in which M represents sodium and x assumes the values 2 or 3. In particular, both β- and δ-sodium disilicates $Na_2Si_2O_5.yH_2O$ are preferred, β-sodium disilicate being able to be obtained, for example, by the method that is described in International Patent Application WO-A-91/08171.

Amorphous sodium silicates with an $Na_2O:SiO_2$ modulus of 1:2 to 1:3.3, preferably, of 1:2 to 1:2.8 and, in particular, of 1:2 to 1:2.6, which are dissolution-delayed and exhibit multiple wash properties, can also be used. The dissolution delay compared with conventional amorphous sodium silicates may have been brought about in various ways, for example, by surface treatment, compounding, compacting/condensing or by overdrying. There is meant by the term "amorphous" in the context of this invention also "X-ray amorphous." This means that in X-ray diffraction tests the silicates do not supply any sharp X-ray reflexes of the type that are typical of crystalline substances, but at most one or more peaks of the scattered X-ray radiation, which exhibit a width of several degree units of the diffraction angle. It is however quite possible even for particularly good builder properties to be obtained if the silicate particles supply faded or even sharp diffraction peaks during electron diffraction tests. This is to be so interpreted that the products exhibit microcrystalline areas 10 to a few hundred nm in size, values up to at most 50 nm and in particular up to at most 20 nm being preferred. These silicates known as X-ray amorphous silicates, which also exhibit a dissolution delay compared with the conventional water glasses, are disclosed, for example, in German Patent Application DE-A-44 00 024. Preferred, in particular, are condensed/compacted amorphous silicates, compounded amorphous silicates and overdried X-ray amorphous silicates.

The finely crystalline, synthetic zeolite, containing bound water, that is used is preferably Zeolite A and/or P. Zeolith MAP® (manufactured by Crosfield). Particularly preferred is Zeolite P. Also suitable, however, are Zeolite X and mixtures of A, X and/or P. Also commercially available and preferably usable in the context of the present invention is, for example, a co-crystallite of Zeolite X and Zeolite A (approximately 80% by weight Zeolite X), which is sold by SASOL under the trade name VEGOBOND AX® and can be described by the formula $$n\mathrm{Na_2O}.(1-n)\mathrm{K_2O}.\mathrm{Al_2O_3}.(2-2.5)\mathrm{SiO_2}.(3.5-5.5)\ \mathrm{H_2O}$$

$$n=0.90-1.0.$$

The zeolite can be used as a spray-dried powder or as a stabilized, undried suspension still moist from its manufacture. If the zeolite is used as a suspension, the suspension can contain small additions of nonionic surfactants as stabilizers, for example, 1 to 3% by weight, based on zeolite, of ethoxylated $C_{12}$-$C_{18}$ fatty alcohols with 2 to 5 ethylene oxide groups, $C_{12}$-$C_{14}$ fatty alcohols with 4 to 5 ethylene oxide groups or ethoxylated isotridecanols. Suitable zeolites exhibit a mean particle size of less than 10 μm (distribution by volume; measuring method: Coulter Counter) and contain preferably 18 to 22% by weight, in particular, 20 to 22% by weight of bound water.

Use of the generally known phosphates as builder substances is obviously also possible, unless such a use ought to be avoided on ecological grounds. In particular, the sodium salts of the orthophospates, the pyrophosphates and, in particular, the tripolyphosphates are suitable.

Among the compounds acting as bleaching agents and supplying $H_2O_2$ in water, sodium perborate tetrahydrate and sodium perborate monohydrate have particular importance. Other suitable bleaching agents include, for example, sodium percarbonate, peroxypyrophosphates, citrate perhydrates and $H_2O_2$-supplying peracid salts and per-acids such as perbenzoates, peroxophthalates, diperazelaic acid, phthaloiminoper-acid or diperdodecane diacid.

In order to achieve an improved bleaching effect during washing at temperatures of 60° C. and less, bleach activators can be worked into the detergents and cleaning compositions to be produced according to the invention. Suitable bleach activators include compounds that under perhydrolysis conditions produce aliphatic peroxocarboxylic acids preferably with 1 to 10 carbon atoms, in particular, 2 to 4 carbon atoms, and/or optionally substituted per(oxy)benzoic acid. Substances which bear O- and/or N-acyl groups with the above-mentioned number of carbon atoms and/or optionally substituted benzoyl groups are suitable. Preferred are alkylene diamines acylated a plurality of times, in particular, tetraacetylethylene diamine (TAED), acylated triazine derivatives, in particular 1,5-diacetyl-2,4-dioxohexahydro-1,3,5-triazine (DADHT), acylated glycolurils, in particular, tetraacetylglycoluril (TAGU), N-acyl imides, in particular, N-nonanoyl succinimide (NOSI), acylated phenolsulfonates, in particular, n-nonanoyl- or isononanoyloxybenzenesulfonate (n- or iso-NOBS), carboxylic acid anhydrides, in particular, phthalic anhydride, acylated polyhydric alcohols, in particular, triacetin, ethylene glycol diacetate and 2,5-diacetoxy-2,5-dihydrofuran.

In addition to the conventional bleach activators, or instead of them, what are known as bleach catalysts can also be worked into the liquid detergents and cleaning compositions. These substances are bleach-reinforcing transition metal salts or transition metal complexes such as, for example, Mn, Fe, Co, Ru or Mo salts complexes or carbonyl complexes. Mn, Fe, Co, Ru, Mo, Ti, V and Cu complexes with nitrogen-containing tripod ligands as well as Co-, Fe-, Cu- and Ru-amine complexes can also be used as bleach catalysts.

The liquid detergent and cleaning composition to be produced according to the invention preferably contains at least one thickener.

Preferred liquid detergents and cleaning compositions can contain enzymes in encapsulated form and/or directly in the detergent and cleaning composition preparation. Suitable enzymes include, in particular, those from the classes of the hydrolases such as the proteases, esterases, lipases, or lipolytically active enzymes, amylases, cellulases or other glycosylhydrolases and mixtures of the above-mentioned enzymes. All of these hydrolases contribute to the removal of stains such as protein-, fat- or starch-containing stains and greying in the washing. Cellulases and other glycosylhydrolases can, in addition, contribute to color retention and to increasing the softness of the textile by the removal of pilling and microfibrils. Oxireductases can also be used for bleaching and for inhibiting color transfer. Particularly well suited are enzymatic agents obtained from bacterial strains or fungi such as *Bacillus subtilis, Bacillus licheniformis, Streptomyceus griseus* and *Humicola insolens*. Preferably proteases of the Subtilisin type and, in particular, proteases that are obtained from *Bacillus lentus* are used.

Of particular interest here are enzyme mixtures, for example, from protease and amylase or protease and lipase or lipolytically acting enzymes or protease and cellulase or from cellulase and lipase or lipolytically acting enzymes or from protease, amylase and lipase or lipolytcally acting enzymes or protease, lipase or lipolytically acting enzymes and cellulase, in particular, however protease- and/or lipase-containing mixtures or mixtures with lipolytically active enzymes. Examples of such lipolytically active enzymes are the known cutinases. Peroxidases or oxidases have also proven to be suitable in some cases. The suitable amylases include, in particular, α-amylases, iso-amylases, pullulanases and pectinases. Preferably cellobiohydrolases, endoglucanases and β-glucosidases, which are also called cellobiases, or mixtures thereof are used as cellulases. As various cellulase types differ through their CMCase and avicelase activities, the desired activities can be set by specific mixtures of the cellulases.

The enzymes can be adsorbed on carriers in order to protect them against premature destruction. The proportion of the enzymes, enzyme mixtures or enzyme granules directly in the detergent and cleaning composition preparation can be, for example, from about 0.1 to 5% by weight, preferably 0.12 to about 2.5% by weight.

A wide range of the different salts from the group of the inorganic salts can be used as electrolytes. Preferred cations are the alkali and alkaline-earth metals; preferred anions are the halides and sulfates. The use of NaCl or $MgCl_2$ in the compositions is preferred on manufacturing grounds. The proportion of electrolytes in the compositions is preferably 0.5 to 5% by weight.

Non-aqueous solvents that can be used in the liquid preparations to be produced according to the invention, and, in particular, in detergents and cleaning compositions, come, for example, from the group of mono- or polyhydric alcohols, alkanolamines or glycol ethers, provided they are miscible with water in the specified concentration range. Preferably the solvents are selected from ethanol, n- or i-propanol, butanols, glycol, propanol or butane-diol, glycerol, diglycol, propyl or butyl diglycol, hexylene glycol, ethylene glycol methyl ether, ethylene glycol ethyl ether, ethylene glycol propyl ether, ethylene glycol mono-n-butylether, diethylene glycol-methyl ether, diethylene glycol ethyl ether, propylene glycol methyl-, ethyl- or propyl-ether, dipropylene glycol monomethyl or ethyl ether, di-isopropylene glycol monomethyl or ethyl ether, methoxy-, ethoxy- or butoxy-triglycol, 1-butoxyethoxy-2-propanol, 3-methyl-3-methoxybutanol, propylene-glycol-t-butyl ether and mixtures of these solvents. Non-aqueous solvents can be used in the liquid preparations, for example, in amounts of between 0.5 and 15% by weight, but preferably of less than 12% by weight and, in particular, of less than 9% by weight. According to another preferred embodiment, however, over 15%, preferably over 20% by weight. In particular, over 25% by weight of non-aqueous solvents are included.

In order to bring the pH value of the liquid preparations, and, in particular, of the liquid detergents and cleaning compositions, into the desired range, the use of pH adjusters can be indicated. Usable here are all known acids or lyes, unless their use is ruled out on application or ecological grounds or on grounds of consumer protection. Conventionally the amount of these adjusters does not exceed 7% by weight of the total formulation.

In order to improve the aesthetic impression of the liquid preparations, and, in particular, of the liquid detergents and cleaning compositions, they can be dyed with suitable dyes. Preferred dyes, of which the selection does not present the skilled person with any difficulties, possess high stability in storage and insensitivity to the other ingredients of the compositions and to light, as well as no pronounced substantivity to textile fibers, in order not to dye them.

Suds suppressors that can be used in the liquid preparations, and, in particular, in the liquid detergents and cleaning compositions include, for example, soaps, paraffins or silicone oils, which can optionally be attached to carriers. Suitable antiredeposition agents, which are also described as "soil repellents," include, for example, nonionic cellulose ethers such as methyl cellulose and methyl hydroxy propyl cellulose with a proportion of methoxy groups of 15 to 30% by weight and of hydroxy propyl groups of 1 to 15% by weight, based in each case on the nonionic cellulose ether, and the polymers, known from the prior art, of phthalic acid and/or terephthalic acid and of their derivatives, in particular, polymers from ethylene terephthalates and/or polyethylene glycol terephthalates or anionically and/or nonionically modified derivatives thereof. Preferred, in particular, among the latter are the sulfonated derivatives of phthalic and terephthalic acid polymers.

Optical brighteners (known as "fluorescent brighteners") can be added to the liquid detergents and cleaning compositions in order to remove greying and yellowing of the treated textile fabrics. These substances key to the fibers and produce a brightening and feigned bleaching effect by converting the invisible ultraviolet radiation into visible longer-wave light, the ultraviolet light absorbed from the sunlight being radiated as slightly blueish fluorescence and producing, with the yellow tone of the greyed or yellowed wash, pure white. Suitable compounds come, for example, from the substance classes of 4,4'-diamino-2,2'-stilbenedisulfonic acids (flavonic acids), 4,4'-distyryl-biphenylene, methyl umbelliferones, cumarins, dihydroquinolines, 1,3-diarylpyrazolines, naphthalic acid imides, benzoxazole, benzisooxazole and benzimidazole systems, and from the pyrene derivatives substituted by heterocycles. The optical brighteners are preferably used in amounts of between 0.03 and 0.3% by weight, based on the finished composition.

Greying inhibitors have the function of keeping the soil dislodged from the fiber suspended in the liquor and hence preventing the redeposition of the soil. Water-soluble colloids, mostly of organic nature, for example, glue, gelatin, salts of ethersulfonic acids of starch or cellulose, or salts of acid sulfuric acid esters of cellulose or starch are suitable for this. Polyamides containing water-soluble acid groups are also suitable for this purpose. Soluble starch preparations and starch products other than those mentioned above can also be used, for example, degraded starch, aldehyde starches, Polyvinylpyrrolidone is also suitable. Preferred, however, are cellulose ethers such as carboxy methyl cellulose (Na salt), methyl cellulose, hydroxyalkyl cellulose and mixed ethers such as methyl hydroxy ethyl cellulose, methyl hydroxy propyl cellulose, methyl carboxy-methyl cellulose and mixtures thereof in amounts of preferably 0.1 to 5% by weight, based on the compositions.

Since textile fabrics, in particular, of rayon, rayon staple, cotton and mixtures thereof, can be prone to creasing, because the individual fibers are sensitive to sagging, buckling, pressing and squeezing at right angles to the fiber direction, the compositions can contain synthetic crease-proofing agents. These include, for example, synthetic products based on fatty acids, fatty acid esters, fatty acid amides, fatty acid alkylol esters, fatty acid alkylol amides or fatty alcohols, which are mostly reacted with ethylene oxide, or products based on lecithin or modified phosphoric acid esters.

For combating microorganisms, the liquid detergents and cleaning compositions can contain antimicrobial agents. A distinction is made here, as a function of antimicrobial spectrum and mechanism of action, between bacteriostatics and bactericides, fungistatics and fungicides, Important substances in these groups are, for example, benzalkonium chlorides, alkylaryl sulfonates, halogen phenols and phenol mercuriacetate, it being possible also to dispense completely with these compounds in the case of the compositions according to the invention.

In order to prevent undesirable changes in the liquid detergents and cleaning compositions and/or the treated textile fabrics that are due to the action of oxygen and other oxidative processes, the compositions can contain antioxidants. This class of compounds includes, for example, substituted phenols, hydroquinones, pyrocatechols and aromatic amines, as well as organic sulfides, polysulfides, dithiocarbamates, phosphites and phosphonates.

Increased wearing comfort can result from the additional use of antistatics, which are additionally added to the compositions. Antistatics increase the surface conductivity and thus permit an improved flowing off of charges formed.

External antistatics are generally substances with at least one hydrophilic molecular ligand and produce on the surfaces a more or less hygroscopic film. These mostly interfacially active antistatics can be divided into nitrogen-containing (amines, amides, quaternary ammonium compounds), phosphorus-containing (phosphoric acid esters) and sulfur-containing (alkylsulfonates, alkylsulfates) antistatics. External antistatics are disclosed, for example, in the patent applications FR 1 156 513, GB 873 214 and GB 839 407. The lauryl-(or stearyl)-dimethylbenzylammonium chlorides disclosed here are suitable as antistatics for textile fabrics or as an additive to detergents, a fabric softening effect additionally being achieved.

In order to improve the water uptake and the re-wettability of the treated textile fabrics, and to facilitate ironing of the treated textile fabrics, silicone derivatives, for example, may be used in the liquid detergents and cleaning compositions. Silicone derivatives additionally improve the flushing out characteristics of the compositions due to their suds suppressing properties. Preferred silicone derivatives are, for example, polydialkyl- or alkylarylsiloxanes, in which the alkyl groups contain one to five carbon atoms and are wholly or partly fluorinated. Preferred silicones are polydimethylsiloxanes, which can optionally be derivatized and are then amino-functional or quaternized or exhibit Si—OH—, Si—H and/or Si—Cl bonds. The viscosities of the preferred silicones at 25° C. are in the range between 100 and 100,000 mPas, the silicones being able to be used in amounts of between 0.2 and 5% by weight, based on the whole composition.

Finally, the liquid detergents and cleaning compositions can also contain UV absorbers, which key onto the treated textile fabrics and improve the light fastness of the fibers. Compounds that exhibit these desired properties include, for example, the compounds and derivatives of benzophenone with substituents in the 2- and 4-position, which are effective due to radiation-free deactivation. In addition, substituted benzotriazoles, acrylates phenyl-substituted in the 3-position (cinnamic acid derivatives), optionally with cyano groups in the 2-position, salicylates, organic Ni complexes and natural substances such as umbelliferone and the body's own urocanic acid are also suitable.

In order to prevent the decomposition of specific detergent ingredients that are catalyzed by heavy metals, substances can be used which complex heavy metals. Suitable heavy metal complexing agents are, for example, the alkali salts of ethylene diamine tetraacetic acid (EDTA) or of nitrilotriacetic acid (NTA), as well as alkali metal salts of anionic polyelectrolytes such as polymaleates and polysulfonates.

A preferred class of complexing agents are the phosphonates, which are contained in preferred liquid detergents and cleaning compositions in amounts of 0.01 to 2.5% by weight, preferably, 0.02 to 2% by weight and, in particular, of 0.03 to 1.5% by weight. These preferred compounds include, in particular, organophosphonates such as, for example, 1-hydroxyethane-1,1-diphosphonic acid (HEDP), aminotri(methylenephosphonic acid) (ATMP), diethylene triamine-penta (methylene phosphonic acid) (DTPMP or DETPMP and 2-phosphonobutane-1,2,4-tricarboxylic acid (PBS-AM), which are used mostly in the form of their ammonium or alkali metal salts.

The aqueous liquid preparations obtained, in particular, detergents and cleaning compositions, are preferably clear, contain no sediment and are, in particular, preferably transparent or at least translucent.

The detergents and cleaning compositions produced according to the invention can, in particular, be used for the cleaning of textile fabrics.

According to a preferred embodiment the liquid composition to be produced according to the invention is a textile treatment agent, an ironing aid, a detergent, a cleaning composition, in particular, for hard and/or soft surfaces, a household cleaner, a toilet preparation, a washing aid, a fabric conditioner, a room odorizer, an air freshener, a conditioning agent, a coloring agent, a fabric softener, a pharmaceutical composition, a plant protection agent, a polishing agent, a foodstuff, a cosmetic composition, a fertilizer, a building material, an adhesive, a bleaching agent, a deliming agent, a car care product, floor cleaner, stove cleaner, leather conditioner, furniture conditioner, a scouring agent, a disinfectant, an odorizer, a mould remover and/or an intermediate of the above-mentioned agents. These compositions to be produced according to the invention represent a preferred embodiment of the invention, in particular, as a gel.

Specific compositions that are very much preferred within the scope of the present invention will be listed hereinafter. The preferred liquid cleaning compositions to be produced according to the invention include toilet cleaners or WC cleaners, products for the cleaning of WC bowls and urinals, which are supplied as liquids, preferably gels. As well as other conventional ingredients such as surfactants, they preferably contain organic acids (for example, citric acid and/or lactic acid) or sodium hydrogensulfate, amidosulfuric acid or phosphoric acid for removing lime deposits or what is known as urinary calculus. These compositions to be produced according to the invention represent a preferred embodiment of the invention, in particular, as a gel.

The preferred liquid cleaning compositions to be produced according to the invention also include pipe cleaning compositions or outflow cleaners. These are preferably strongly alkaline preparations which are generally used to remove pipe blockages of organic materials such as hair, fat, food residues, soap deposits, Additions of Al or Zn powder can preferably be used for the formation of $H_2$ gas with a bubbling effect. Possible ingredients preferably include alkalis, alkaline salts, oxidants and neutral salts. Hypochlorite can in particular be included. In addition there are also enzyme-based outflow cleaners. Acid preparations are also preferred. These compositions to be produced according to the invention represent a preferred embodiment of the invention, in particular as a gel.

The preferred liquid cleaning compositions to be produced according to the invention also include universal or all-purpose cleaners or general cleaners. These are universally usable cleaners for all hard surfaces in the home and in industry that are wipable in the wet or moist state. They are generally neutral or weakly alkaline or weakly acid products. All-purpose cleaners or general cleaners preferably contain surfactants, builders, solvents and hydrotropes, dyes, preservatives, These compositions to be produced according to the invention represent a preferred embodiment of the invention, in particular, as a gel.

There are also special disinfectant all-purpose cleaners. Preferably these cleaners additionally contain antimicrobial agents (for example, aldehydes, alcohols, quaternary ammonium compounds, amphoteric surfactants, triclosan). These compositions to be produced according to the invention represent a preferred embodiment of the invention, in particular, as a gel.

The preferred liquid cleaning compositions to be produced according to the invention also include sanitary-ware cleaners. These are liquid products for cleaning the bath and toilet. The alkaline sanitary-ware cleaners are used mainly for removing greasy soil, while the acid sanitary-ware cleaners are used above all to remove lime deposits. Sanitary-ware cleaners advantageously also have a considerable disinfectant action, in particular, the strongly alkaline, chlorine-containing sanitary-ware cleaners. These compositions to be produced according to the invention represent a preferred embodiment of the invention, in particular as a gel.

The preferred liquid cleaning compositions to be produced according to the invention also include oven cleaners or grill cleaners, which are preferably supplied in the form of gels. These cleaners are generally used for the removal of burnt-on or carbonized food residues. Preferably oven cleaners are adjusted to be strongly alkaline, for example, with sodium hydroxide, sodium metasilicate, 2-aminoethanol. In addition, they preferably contain anionic and/or nonionic surfactants, water-soluble solvents and in some cases thickeners such as polycarboxylates and carboxymethylcellulose. These compositions to be produced according to the invention represent a preferred embodiment of the invention, in particular, as a gel.

The preferred liquid cleaning compositions to be produced according to the invention also include metal cleaners. These are liquid cleaners for specific types of metal such as stainless steel or silver. Stainless steel cleaners preferably contain, in addition to acids (preferably up to 3% by weight, for example, citric acid, lactic acid), surfactants (in particular, up to 5% by weight, preferably nonionic and/or anionic surfactants), water, also solvents (preferably up to 15% by weight) for removing fat-containing soils, as well as other substances such as, for example, thickeners and preservatives. Very fine polishing substances are also contained in products for mainly bright stainless steel surfaces. Silver cleaners are for their part preferably acid adjusted. They preferably contain complexing agents (for example, thiourea, sodium thiosulfate) in particular, for removing black deposits of silver sulfide. Typical forms of supply are cleaning cloths, dipping baths, pastes and liquids. For the removal of dark stains (oxide layers), copper and non-ferrous metal cleaners are used (for example, for brass and bronze). These cleaners are generally adjusted to be weakly alkaline (preferably with ammonia) and generally contain polishing agents as well as preferably also ammonium soaps and/or complexing agents. These compositions to be produced according to the invention represent a preferred embodiment of the invention, in particular, as a gel.

The preferred liquid cleaning compositions to be produced according to the invention include also glass cleaners and window cleaners. These liquid preparations are used mainly to remove, in particular, fat-containing dirt from glass surfaces. They preferably contain substances such as anionic and/or nonionic surfactants (in particular, up to 5% by weight), ammonia and/or ethanolaine (in particular, up to 1% by weight), ethanol and/or 2-propanol, glycol ether (in particular, 10 to 30 wt), water, preferably preservatives, dyes, tarnish prevention agents, These compositions to be produced according to the invention represent a preferred embodiment of the invention, in particular, as a gel.

The preferred liquid cleaning compositions to be produced according to the invention also include all special cleaning compositions, for example, those for glass-ceramic cooking surfaces, as well as carpet cleaners and stain removers. These compositions to be produced according to the invention represent a preferred embodiment of the invention, in particular, as a gel.

The preferred liquid car care compositions to be produced according to the invention include paint preservatives, paint polishes, paint cleaners, washing preservatives, shampoos for car washing, car washing and waxing products, polishes for decorative metals, protective films for decorative metals, plastics cleaners, tar removers, windscreen cleaners, engine cleaners. These compositions to be produced according to the invention represent a preferred embodiment of the invention, in particular, as a gel.

Preferred liquid cosmetic compositions to be produced according to the invention are preferably (a) cosmetic liquid compositions for skin care, in particular, bath preparations, skin washing and cleaning compositions, skin care compositions, eye cosmetics, lip care compositions, nail care compositions, personal care compositions, foot care compositions, (b) cosmetic liquid compositions with a specific effect, in particular, light protection compositions, skin tanning compositions, depigmenting compositions, deodorants, antiperspirants, hair removal compositions, shaving preparations, fragrances, (c) cosmetic liquid compositions for dental care, in particular tooth and mouth care compositions, denture care compositions, denture cleaning compositions, denture fixing aids, (d) cosmetic liquid compositions for hair care, in particular hair washing compositions, hair care compositions, hair fixing compositions, hair shaping compositions, hair dyeing compositions. These compositions to be produced according to the invention represent a preferred embodiment of the invention, in particular, as a gel or as other conventional cosmetic forms of administration such as lotions, creams, milk, emulsions, Particularly preferred are also the liquid air fresheners and room odorizers. Such products contain mainly volatile and mostly pleasantly smelling substances, which are advantageously able to cover unpleasant smells even in very small amounts. Air fresheners for living spaces contain in particular natural and/or synthetic essential oils such as, for example, conifer needle oils, citrus oil, eucalyptus oil, lavender oil, for example, in amounts of up to 50% by weight. As aerosols they contain somewhat smaller amounts of such essential oils, for example, less than 5% by weight or less than 2% by weight, and in return, preferably also substances such as acetaldehyde (in particular <0.5% by weight), preferably isopropyl alcohol (in particular <5% by weight), mineral oil (in particular <5% by weight) and propellant gases. Gel concentrates from essential oils can preferably be used.

EXAMPLES

Example 1

Production of a Liquid Detergent

A liquid detergent with a defined viscosity and flow limit was produced (viscosity 4,200 mPas; flow limit 1.2 Pa) by the intermixing of water and surfactants (anionic surfactant, nonionic surfactant, soap), small components (defoamer, perfume) and thickener (for example polyacrylates). Production took place batchwise with a mixing time of 1.5 h/batch.

Speckles were added during the production of the liquid detergent. It was observed that the speckles were torn after a short time. Even if the speckles were added right at the end of the production process, a fair proportion (approximately 25% by weight of the speckles) were still already torn during the mixing and a large proportion (approximately 60% by weight of the speckles) were torn during the discharging and during the transport through various sections of the facility (pipes, valves, pumps, intermediate tanks) up to the pouring stage.

The resulting product made an unprofessional impression of reduced visual quality.

Example 2

Batchwise Working in of a Speckles Dispersion

A 20 l agitated glass container (container diameter: 300 mm/container height: 400 mm with Intermig agitator, agitator diameter (3 AFS): 210 mm and 4 flow spoilers) was filled to 50% by volume with a conventional liquid detergent (viscosity 4,300 mPas with a flow limit of 1.3 Pa) that had been produced beforehand. 250 g of a speckles dispersion (200 g speckles in 800 g water) were then added with an agitator speed of 55 rpm. After 3 minutes all the speckles were already worked homogeneously into the liquid detergent and were able to be poured directly. No tearing of the speckles was observed.

Example 3

Continuous Working in of a Speckles Dispersion

The mixture from Example 2 was used as a starting material. 117 kg/h of conventional liquid detergent and 3 kg/h of the speckles dispersion were added continuously into this starting material, while 200 kg/h of the mixture was removed continuously out of the bottom outlet valve. After 25 minutes of continuous operation, all speckles were once again worked homogeneously into the liquid detergent and were able to be poured directly. No fluctuations in the product occurred. No tearing of the speckles was observed.

The invention claimed is:

1. A method for producing a liquid detergent having solid bodies comprising:

adding the solid bodies to the liquid detergent only during the pouring of the liquid detergent into a packing unit, wherein (a) the packaging unit is partially filled with the liquid detergent, the solid bodies are then added, and the packaging unit is finally filled with another liquid detergent, (b) the solid bodies and liquid detergent are added at the same time in 2 separate streams into the packaging unit, or (c) the solid bodies and liquid detergent are added in one stream, with the liquid detergent and solid bodies being combined just prior to entering the packing unit, flowing together into the packing unit, and wherein the solid bodies and liquid detergent are mixed in a manner that does not lead to high shear input in the liquid detergent.

2. The method as claimed in claim 1, wherein the solid body content is 0.01 to 80% by weight of the whole liquid detergent.

3. The method as claimed in claim 1, wherein the added solid bodies are shear-sensitive.

4. The method as claimed in claim 1, in which the liquid detergent is an aqueous composition.

5. The method as claimed in claim 1, wherein the solid bodies have a diameter along their greatest extension of 0.01 to 20,000 μm.

6. The method as claimed in claim 1, wherein the solid bodies are capsules, microcapsules or speckles.

7. The method as claimed in claim 1, wherein the solid bodies contain hollow microsphere(s).

8. The method as claimed in claim 1, wherein the liquid detergent has a viscosity in the range of 1 to 10,000 mPa s.

9. The method as claimed in claim 1, wherein the solid bodies have substantially a mean shape factor of at least 0.77.

* * * * *